US011018424B2

(12) United States Patent
Yman

(10) Patent No.: US 11,018,424 B2
(45) Date of Patent: May 25, 2021

(54) MULTI RADIATOR ANTENNA COMPRISING MEANS FOR INDICATING ANTENNA MAIN LOBE DIRECTION

(71) Applicant: CELLMAX TECHNOLOGIES, AB, Kista (SE)

(72) Inventor: Niclas Yman, Ekero (SE)

(73) Assignee: Cellmax Technologies AB, Kista (SE)

( * ) Notice: Subject to any disclaimer, the term of this patent is extended or adjusted under 35 U.S.C. 154(b) by 283 days.

(21) Appl. No.: 16/075,646

(22) PCT Filed: Feb. 2, 2017

(86) PCT No.: PCT/SE2017/050088

§ 371 (c)(1),
(2) Date: Aug. 4, 2018

(87) PCT Pub. No.: WO2017/135876

PCT Pub. Date: Aug. 10, 2017

(65) Prior Publication Data

US 2019/0051983 A1 Feb. 14, 2019

(30) Foreign Application Priority Data

Feb. 5, 2016 (SE) ..... 1650147-0

(51) Int. Cl.
*H01Q 3/32* (2006.01)
*H01Q 1/24* (2006.01)
(Continued)

(52) U.S. Cl.
CPC ..... *H01Q 3/32* (2013.01); *H01P 1/183* (2013.01); *H01P 3/06* (2013.01); *H01Q 1/246* (2013.01);
(Continued)

(58) Field of Classification Search
CPC ..... H01Q 3/32; H01Q 1/246; H01Q 1/42; H01Q 9/16; H01Q 19/10; H01Q 21/0006; H01Q 21/08; H01P 1/183; H01P 3/06
See application file for complete search history.

(56) References Cited

U.S. PATENT DOCUMENTS 5,801,600 A 9/1998 Butland et al.
6,683,582 B1 1/2004 Love
(Continued)

FOREIGN PATENT DOCUMENTS

CN 102714354 A 10/2012
EP 0575808 A1 12/1993
(Continued)

OTHER PUBLICATIONS

PCT/SE2016/050863, International Search Report, dated Dec. 16, 2016, Patent-och registreringsverket Box 5055 S-102 42 Stockholm, Sweden.
(Continued)

*Primary Examiner* — Erin F Heard
*Assistant Examiner* — Donald H B Braswell
(74) *Attorney, Agent, or Firm* — The Jansson Firm; Pehr B. Jansson

(57) ABSTRACT

A multi radiator antenna comprising an electrically conductive reflector, at least two radiating elements arranged on said reflector, a feeding network connected to the radiating elements, and a protective cover. The feeding network comprises a plurality of conductors for distributing signals to the radiators. The feeding network has means for adjusting relative phases of said signals in order to adjust a direction of the antenna main lobe of said multi-radiator base station antenna. The means for adjusting is provided with, or is connected to, an indicating portion configured to provide a visual indication of said direction. The protective
(Continued)

cover is provided with an at least partially transparent wall portion arranged such that said indicating portion is visible there through.

24 Claims, 5 Drawing Sheets

(51) Int. Cl.

| | |
|---|---|
| ***H01P 3/06*** | (2006.01) |
| ***H01Q 9/16*** | (2006.01) |
| ***H01Q 19/10*** | (2006.01) |
| ***H01Q 21/00*** | (2006.01) |
| ***H01Q 21/08*** | (2006.01) |
| ***H01P 1/18*** | (2006.01) |
| ***H01Q 1/42*** | (2006.01) |

(52) U.S. Cl.
CPC ..... *H01Q 1/42* (2013.01); *H01Q 9/16* (2013.01); *H01Q 19/10* (2013.01); *H01Q 21/0006* (2013.01); *H01Q 21/08* (2013.01)

(56) References Cited

U.S. PATENT DOCUMENTS

| | | | | |
|---|---|---|---|---|
| 2001/0048351 | A1* | 12/2001 | Love | H01P 1/183 333/156 |
| 2002/0135520 | A1 | 9/2002 | Teillet et al. | |
| 2002/0135527 | A1 | 9/2002 | Teillet et al. | |
| 2004/0203284 | A1 | 10/2004 | Stolle et al. | |
| 2004/0263389 | A1 | 12/2004 | Haunberger et al. | |
| 2005/0134517 | A1 | 6/2005 | Gottl | |
| 2007/0241984 | A1 | 10/2007 | Schadler | |
| 2008/0139044 | A1 | 6/2008 | Hantsch et al. | |
| 2010/0001811 | A1 | 1/2010 | Haunberger et al. | |
| 2010/0007571 | A1 | 1/2010 | Riedel | |
| 2010/0201590 | A1* | 8/2010 | Girard | H01Q 3/32 343/766 |
| 2010/0283710 | A1 | 11/2010 | Lutman et al. | |
| 2013/0088402 | A1 | 4/2013 | Lindmark et al. | |
| 2013/0278478 | A1* | 10/2013 | Jonsson | H01P 5/026 343/853 |
| 2014/0035698 | A1 | 2/2014 | Schadler et al. | |
| 2014/0139387 | A1 | 5/2014 | Jones et al. | |
| 2015/0109183 | A1 | 4/2015 | Smith | |
| 2015/0180135 | A1 | 6/2015 | Jonsson et al. | |
| 2016/0218411 | A1* | 7/2016 | Yu | G01C 9/12 |

FOREIGN PATENT DOCUMENTS

| | | | |
|---|---|---|---|
| KR | 20100117838 | A | 11/2010 |
| WO | WO8605325 | A1 | 9/1986 |
| WO | WO02067374 | A1 | 8/2002 |
| WO | WO2005060049 | A1 | 10/2005 |
| WO | WO2005101566 | A1 | 10/2005 |
| WO | WO2006006913 | A1 | 1/2006 |
| WO | WO2009041896 | A1 | 4/2009 |
| WO | WO2012003506 | A2 | 1/2012 |
| WO | WO2012103821 | A2 | 8/2012 |
| WO | WO2014120062 | A1 | 8/2014 |
| WO | WO2017048181 | A1 | 3/2017 |
| WO | WO2017048182 | A1 | 3/2017 |

OTHER PUBLICATIONS

PCT/SE20161050863, Written Opinion of the International Searching Authority, dated Dec. 16, 2016, Patent-och registreringsverket Box 5055 S-102 42 Stockholm, Sweden.
PCT/SE2017/050087, International Search Report, dated May 4, 2017, Patent-och registreringsverket Box 5055 S-10242 Stockholm, Sweden.
PCT/SE2017/050087, Written Opinion of the International Searching Authority, dated May 4, 2017, Patent-och registreringsverket Box 5055 S-10242 Stockholm, Sweden.
PCT/SE2017/050088, International Search Report, dated Apr. 28, 2017, Patent-och registreringsverket Box 5055 S-10242 Stockholm, Sweden.
PCT/SE2017/050088, Written Opinion of the International Searching Authority, dated Apr. 28, 2017, Patent-och registreringsverket Box 5055 S-10242 Stockholm, Sweden.
PCT/SE2017/050618, International Search Report, dated Aug. 30, 2017, Patent-och registreringsverket Box 5055 S-10242 Stockholm, Sweden.
PCT/SE2017/050618, Written Opinion of the International Searching Authority, dated Aug. 30, 2017, Patent-och registreringsverket Box 5055 S-10242 Stockholm, Sweden.
PCT/SE2016/050864, International Search Report, dated Nov. 30, 2016, Patent-och registreringsverket Box 5055 S-10242 Stockholm, Sweden.
PCT/SE2016/050864, Written Opinion of the International Searching Authority, dated Nov. 30, 2016, Patent-och registreringsverket Box 5055 S-10242 Stockholm, Sweden.
PCT/SE2016/050867, International Search Report, dated Dec. 14, 2016, Patent-och registreringsverket Box 5055 S-10242 Stockholm, Sweden.
PCT/SE2016/050867, Written Opinion of the International Searching Authority, dated Dec. 14, 2016, Patent-och registreringsverket Box 5055 S-10242 Stockholm, Sweden.
PCT/SE2016/050868, International Search Report, dated Dec. 16, 2016, Patent-och registreringsverket Box 5055 S-10242 Stockholm, Sweden.
PCT/SE2016/050868, Written Opinion of the International Searching Authority, dated Dec. 16, 2016, Patent-och registreringsverket Box 5055 S-10242 Stockholm, Sweden.

* cited by examiner

MULTI RADIATOR ANTENNA COMPRISING MEANS FOR INDICATING ANTENNA MAIN LOBE DIRECTION

FIELD OF THE INVENTION

The invention relates to the field of multi-radiator antennas comprising a feeding network having at least one coaxial line.

BACKGROUND

Multi-radiator antennas are frequently used in for example cellular networks. Such multi-radiator antennas comprise a number of radiating antenna elements for example in the form of dipoles for sending or receiving signals, an antenna feeding network and an electrically conductive reflector. The antenna feeding network distributes the signal from a common coaxial connector to the radiators when the antenna is transmitting and combines the signals from the radiators and feeds them to the coaxial connector when receiving. A possible implementation of such a feeding network is shown in FIG. 1.

In such a network, if the splitters/combiners consist of one junction between e.g. 3 different 50 ohm lines, impedance match would not be maintained, and the impedance seen from each port would be 25 ohm instead of 50 ohm. Therefore the splitter/combiner usually also includes an impedance transformation circuit which maintains 50 ohm impedance at all ports.

A person skilled in the art would recognize that the feeding is fully reciprocal in the sense that transmission and reception can be treated in the same way, and to simply the description of this invention only the transmission case is described below.

The antenna feeding network may comprise a plurality of coaxial lines being substantially air filled, each coaxial line comprising a central inner conductor at least partly surrounded by an outer conductor with insulating air in between. The coaxial lines and the reflector may be formed integrally with each other in the sense that the outer conductors and the reflector are formed in one piece.

In a multi radiator antenna, the radiators may be positioned in a vertical column. During installation or tuning, the tilt angle may be adjusted. This may either be done physically, i.e. by mechanically tilting the complete antenna, or alternatively electrically by adjusting the electrical tilt angle. The antenna electrical tilt angle is determined by the relative phases of the signals radiating from the radiators. The relative phases can be fixed giving the antenna a predetermined tilt angle, or the relative phases can be variable if a variable tilt angle is required.

A phase shifting arrangement may be achieved using one or more dielectric elements which co-operate with one or more conductors. The phase shift may be adjusted by moving the dielectric element(s) relative the conductors. In the case of a substantially air filled coaxial line, dielectric element(s) can be arranged inside the coaxial line(s). It is a known physical property that introducing a material with higher permittivity than air in a substantially air filled coaxial line will reduce the phase velocity of a signal propagating along that transmission line. This can also be perceived as delaying the signal or introducing a phase lag compared to a coaxial line that has no dielectric material between the inner and outer conductors. The phase shift is achieved by moving the dielectric element that is located between the inner conductor and the outer conductor of the coaxial line. If the dielectric element is moved in such a way that the outer conductor will be more filled with dielectric material, the phase shift will increase.

Tilt angle in variable tilt antennas is often monitored by having e.g. a scale stick protruding through the bottom of the antenna, or from a motor unit attached to the antenna. A disadvantage with such a scale stick is that an opening is required in the environmental protection of the antenna or the motor unit. The scale stick can also easily be damaged, and might be impacted by ice building on the antenna.

WO 2009/041796 discloses an antenna arrangement having an adjustable differential phase shifter including a movable dielectric part arranged inside outer conductors of the coaxial lines. One disadvantage with this and other known arrangements is that it may be difficult to determine the actual electrical tilt achieved by moving the dielectric part(s).

SUMMARY

An object of the present invention is to provide an improved multi radiator antenna, which may at least partly solve or improve on the disadvantages of the prior art described above.

These and other objects are achieved by the present invention by means of a multi radiator antenna according to the independent claim.

According to the invention, a multi-radiator base station antenna is provided. The multi radiator antenna comprises an electrically conductive reflector, at least two radiating elements arranged on said reflector, a feeding network connected to the radiating elements, and a protective cover. The feeding network comprises a plurality of conductors for distributing signals to the radiators. The feeding network has means for adjusting relative phases of said signals in order to adjust a direction of the antenna main lobe of said multi-radiator base station antenna. The means for adjusting is provided with, or is connected to, an indicating portion or element configured to provide a visual indication of said direction. The protective cover is provided with an at least partially transparent wall portion arranged such that said indicating portion or element is visible there through. The protective cover may be arranged to protect the feeding network.

Put differently, the antenna feeding network may be provided with means for adjusting the phase in at least one of said plurality of conductors, in order to adjust the relative phase of at least two signals, thereby adjusting the electrical tilt angle in a multi-radiator base station. The means for adjusting may be provided with an indicating portion or element configured to provide a visual indication of the electrical tilt angle. Alternatively, the indicating portion or element may be a separate part which is attached or connected to (but separate from) the means for adjusting.

The protective cover may be arranged to surround or cover at least parts of the antenna feeding network. For example, the protective cover may cover or protect the rear side of the antenna feeding network, while the front side may be covered or protected by the reflector. In other embodiments the protective cover may surround or cover not only the antenna feeding network, but also at least parts of the reflector and/or the radiators. The protective cover may be formed by two or more cover portions. It is understood that the at least partially transparent wall portion may be located at any part of the protective cover or portions thereof as long as the indicating portion or element is visible there through.

The invention is based on the insight that an accurate indication of the actual direction of the antenna main lobe or the actual electrical tilt angle may be provided to the user of the antenna by providing the means for adjusting relative phases in the internal antenna feeding network with an indicating portion or element which is visible through a transparent wall portion of the protective cover which surrounds or protects the feeding network. By providing the already existing protective cover with a transparent wall portion which makes the indicating portion visible from the exterior of the antenna feeding network, a compact solution is achieved which does not add to the size of the antenna. The invention is further based on the insight that a robust and reliable antenna may be achieved by providing the indicating portion inside the protective cover.

It is understood that the directions referred to in this application relate to a multi-radiator base station antenna where a plurality of coaxial lines are arranged side by side in parallel to each other and also in parallel with a reflector on which the radiating elements are arranged. Longitudinally in this context refers to the lengthwise direction of the coaxial lines, and sideways refers to a direction perpendicular to the lengthwise direction of the coaxial lines. It is also understood that the term encircle used herein refers in general to completely surrounding an object, and is not limited to a circular surrounding shape. It is furthermore understood that the rear side of the antenna feeding network refers to the side which is opposite the reflector side, which reflector side is provided with the radiating elements.

In embodiments, the plurality of conductors of said feeding network are configured as substantially air filled coaxial lines, each comprising a central inner conductor and an elongated outer conductor substantially surrounding the central inner conductor. Such substantially air filled coaxial lines have the advantage that low losses in the feeding network may be achieved. In other words, the feeding network comprises a plurality of substantially air filled coaxial lines, each comprising an inner conductor centrally arranged in an elongated outer conductor with air in-between, where each central inner conductor is at least partly surrounded by the corresponding outer conductor. The central inner conductor(s) may be substantially surrounded by the corresponding outer conductor in the sense that one or more openings are provided in the outer conductor, which may be small openings with limited extension in the longitudinal direction of the coaxial line, provided for example to allow electrical connection(s) to the inner conductor. In embodiments, the central inner conductor(s) may be encircled or completely surrounded by the outer conductor in the sense that the outer conductor forms a closed loop around the inner conductor as seen in a cross section perpendicular to the longitudinal direction of the coaxial line. The air between the conductors replaces the dielectric often found in coaxial cables between the inner and outer conductor. The outer conductor may in embodiments be a tube-shaped element having a square cross section. It is understood that the term substantially air filled is used to describe that the coaxial line may not be provided solely with air in between the outer and inner conductors. In embodiments described below, the antenna feeding network may be provided with further components inside the outer conductor such as an elongated rail element and dielectric elements which also occupies part of the space inside the outer conductor which would otherwise be filled with air. The coaxial line is thus substantially, but not completely air filled in these embodiments.

In embodiments, the means for adjusting relative phases of said signals is configured to adjust the antenna main beam angle in the elevation plane. In these embodiments, the indicating portion may be configured to provide a visual indication of the electrical tilt in the elevation plane.

In embodiments, the at least partially transparent wall portion comprises a scale, wherein said indicating portion is configured to form an indicator co-acting with said scale to indicate said position. Put differently, the at least partially transparent wall portion and/or a wall portion of the protective cover being adjacent the at least partially transparent wall portion is provided with a scale, i.e. a graded or scaled reference portion on which, due to its location adjacent the indicating portion, a position of the indicating portion may be read visually. This embodiment is advantageous since a purely mechanical solution of determining the position of the indicating portion may be achieved, which may be reliable. The indicating portion may be slidably arranged relative the scale.

In embodiments, the means for adjusting comprises at least one dielectric element, each being configured to cooperate with at least one of said conductors to provide a phase shifting arrangement. In the case where the conductors are substantially air filled coaxial lines, each dielectric element is arranged inside one of the outer conductors and at least partly fills the space between the outer and inner conductors. The at least one dielectric element may have a U-shaped profile such as to partly surround the inner conductor in order to at least partly fill out the cavity between the inner and outer conductors.

In embodiments, the means for adjusting comprises displacement means configured to displace said at least one dielectric element and said indicating portion. The displacement means may comprise an at least partly threaded rod which extends longitudinally, where the dielectric element and the indicating portion are provided with, or attached to, a corresponding connecting element having an internally threaded portion arranged to move in the longitudinal direction of the antenna when the rod is rotated. The displacement means may comprise a manual actuating arrangement configured to actuate said displacement means, which actuating arrangement may comprise a handle or knob, which may be arranged to rotate the above mentioned rod. Alternatively, the displacement means comprises an electrical actuating arrangement configured to actuate the displacement means, and optionally means for controlling said electrical actuating arrangement from a distance. The electrical actuating arrangement may comprise at least one electric motor, which may be arranged to rotate the above mentioned rod. These embodiments are advantageous since a simple and reliable arrangement, which may displace or move the dielectric elements accurately, is achieved.

In embodiments where the conductors are substantially air filled coaxial lines, the antenna may further comprise at least one elongated rail element, each being slideably arranged inside an outer conductor of said coaxial lines, said rail element being longitudinally movable in relation to said outer conductor. The elongated rail element may be described as a bar-shaped element, i.e. an element which is substantially longer than wide, which is also wider than thick. The means for adjusting may further comprise at least one connecting element connected to the rail element of at least one of said coaxial lines, said connecting element being provided with said indicating portion, and wherein each of said at least one dielectric element is configured to cooperate with a corresponding coaxial line by being attached to an elongated rail element arranged therein. The outer conductor may be provided with at least one longitudinally extending slot, and wherein said connecting element is connected to the rail element through said slot. In embodiments where the means for adjusting comprises displacement means in the form of an at least partly threaded and longitudinally extending rod, each connecting element is provided with an internally threaded portion, the internally threaded portions being configured to co-operate with corresponding (externally) threaded segments or portions of the rod.

In embodiments, means for adjusting is configured to achieve more phase shift in one coaxial line than in another, i.e. to control the relative phases, in order to control the electrical antenna tilt angle. This may be achieved by having dielectric elements of different sizes, and/or by moving the rails and corresponding dielectric elements at different relative speeds, and/or by using dielectric elements with different dielectric constants. In such an embodiment, the means for adjusting may be configured to move at least two rail elements of the coaxial lines simultaneously at different speeds. Because the rail elements and the dielectric elements attached thereto move at different speed, and/or because the dielectric elements are of different sizes and/or have different dielectric constant, more phase shift will be achieved in at least one of the coaxial lines than in at least one other of the coaxial lines. In embodiments where the means for adjusting comprises displacement means in the form of an at least partly threaded and longitudinally extending rod, the means for adjusting may further comprise at least first and second connecting elements, each connecting element being connected to a corresponding separate rail element, each connecting element being provided with an internally threaded portion, the internally threaded portions being configured to co-operate with corresponding (externally) threaded segments or portions of the rod, wherein the threaded segments or portions of the rod have different pitch from each other such that the first and second connecting elements move at different speed when the rod is rotated. In other words, the internally threaded portion of the first connecting element has a first pitch and is engaged with a first threaded segment on the rod having the first pitch, and the internally threaded portion of the second connecting element has a second pitch, which is different from the first pitch, and is engaged with a second threaded segment on the rod having the second pitch.

The embodiments described above may be combined in any practically realizable way.

BRIEF DESCRIPTION OF THE DRAWINGS

These and other aspects of the present invention will now be described in more detail with reference to the appended drawings, which show presently preferred embodiments of the invention, wherein.

DETAILED DESCRIPTION

Figure 1:
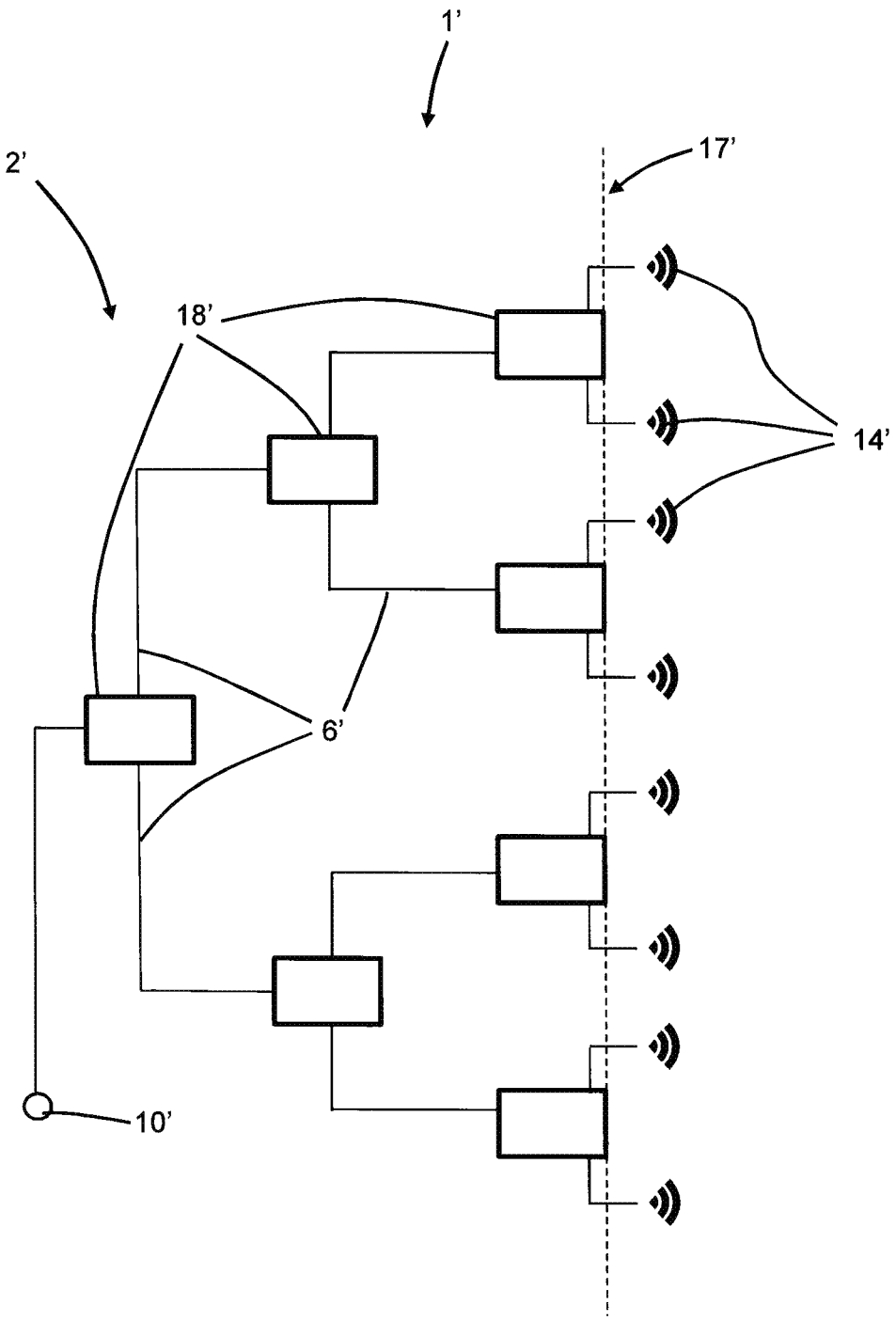
FIG. 1 shows a schematic view of a multi radiator antenna.

FIG. 1 schematically illustrates a multi radiator antenna 1' comprising an antenna feeding network 2', an electrically conductive reflector 17', which is shown schematically in FIG. 1, and a plurality of radiating elements 14'. The radiating elements 14' may be dipoles. The antenna feeding network 2' connects a coaxial connector 10' to the plurality of radiating elements 14' via a plurality of lines 6' which may be coaxial lines, which are schematically illustrated in FIG. 1. The signal to/from the connector 10' is split/combined using, in this example, three stages of splitters/combiners 18'.

Figure 2:
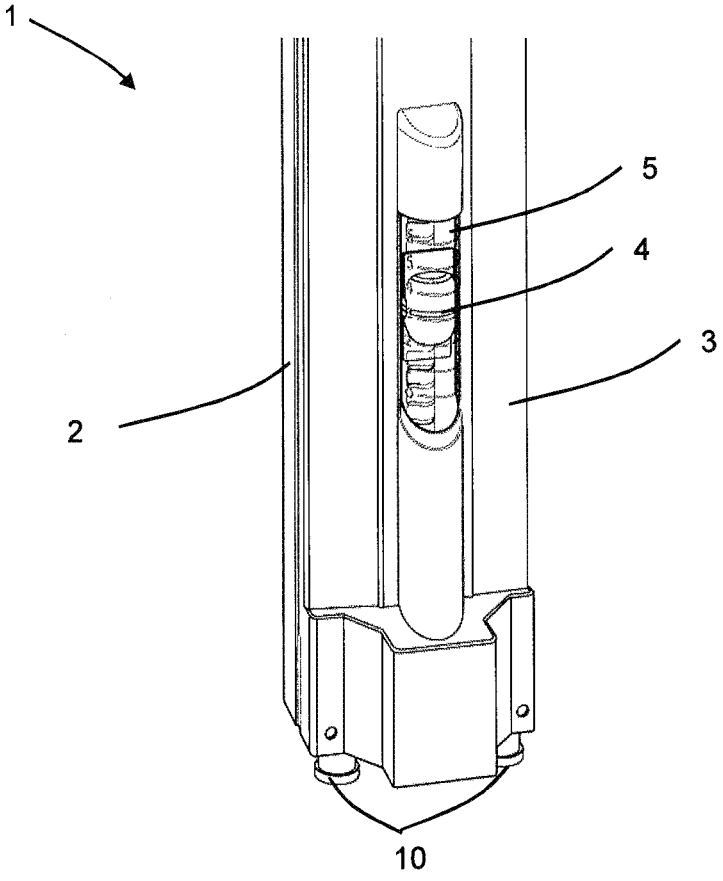
FIG. 2 shows a multi radiator antenna according to an embodiment of the invention.

FIG. 2 shows a multi radiator antenna 1 according to an embodiment of the invention, as seen from the rear side of the antenna. The antenna comprises an antenna feeding network 2 and a protective cover 3 which covers the rear side of the antenna feeding network to provide protection therefore. The front side of the antenna feeding network (not visible) is protected by the reflector (also not visible). In other embodiments, the protective cover may cover or encapsulate the entire antenna feeding network or even the entire antenna. In yet other embodiments, two protective covers or cover portions are provided, one which covers the rear side of the antenna/antenna feeding network, and one which covers the front side of the antenna, i.e. covers the reflector and the radiators (not shown in FIG. 2). The protective cover is made of a plastic material. The antenna feeding network 2 comprises a plurality of substantially air filled coaxial lines for distributing signals between the coaxial connectors 10 and the radiators (not shown) of the multi-radiator base station antenna. Each coaxial line comprises a central inner conductor and an elongated outer conductor surrounding the central inner conductor. In the figure, the inner and outer conductors are not shown, being hidden behind the protective cover.

The feeding network has means for adjusting (not shown) relative phases of said signals in order to adjust a direction of the antenna main lobe of said multi-radiator base station antenna. The means for adjusting is provided with an indicating portion 4 formed as a rounded protrusion having an indicating line or groove thereon. The indicating portion is configured to provide a visual indication of the electrical elevation tilt angle. The protective cover is provided with a transparent wall portion 5 through which the indicating portion 4 is visible. The transparent wall portion 5 is formed as a half-cylinder shaped protrusion in which the indicating portion 4 is movable in the longitudinal direction (up- and downwards as seen in the figure). The transparent wall portion 5 comprises a scale, wherein said indicating portion is configured to form an indicator co-acting with said scale to indicate said position. In other embodiments, a wall portion of the protective cover being adjacent the transparent wall portion is provided with a scale, i.e. a graded or scaled reference portion on which, due to its location adjacent the indicating portion, a position of the indicating portion may be read visually.

Figure 3:
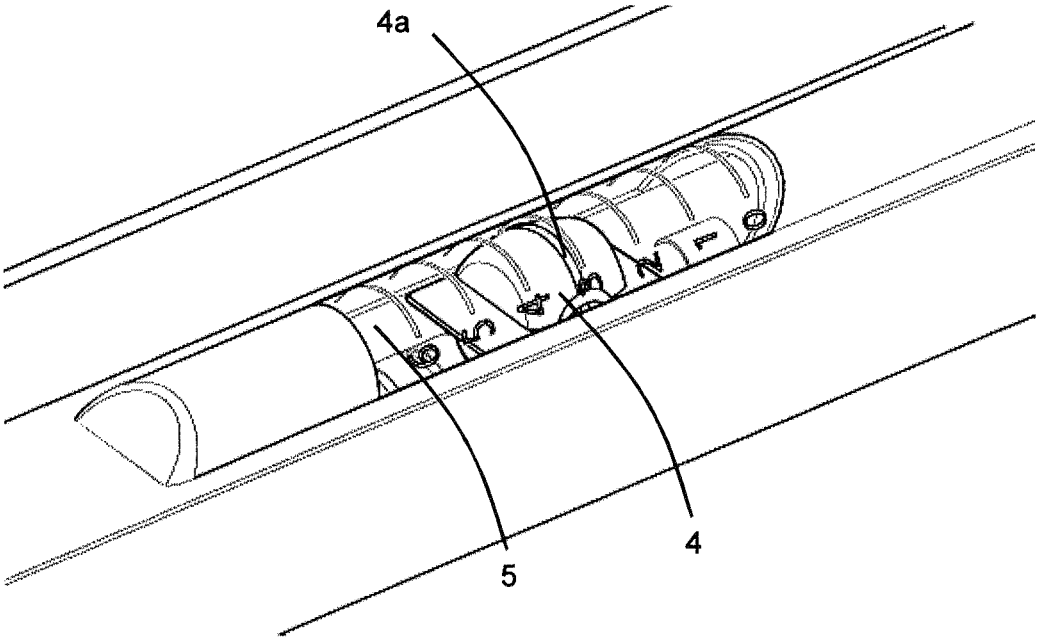
FIG. 3 shows a detail view of the antenna in FIG. 2.

FIG. 3 shows a detail view of the antenna in FIG. 2 in which the indicating portion 4 and the transparent wall portion 5 are seen more clearly. As explained above, the indicating portion 4 is provided with an indicating line or groove 4*a*, which may be colored to be clearly visible outdoors. In this embodiment, the scale on the transparent wall portion 5 is graded from 0 to 6. When the means for adjusting relative phases is adjusted, the indicating portion 4 is moved, and the position of the indicating line or groove 4*a* on the scale can be easily read through the transparent wall portion. Thus, a phase shift value between 0 and 6 which is directly correlated to the actual relative phase or electrical tilt angle can be visually determined.

Figure 4:
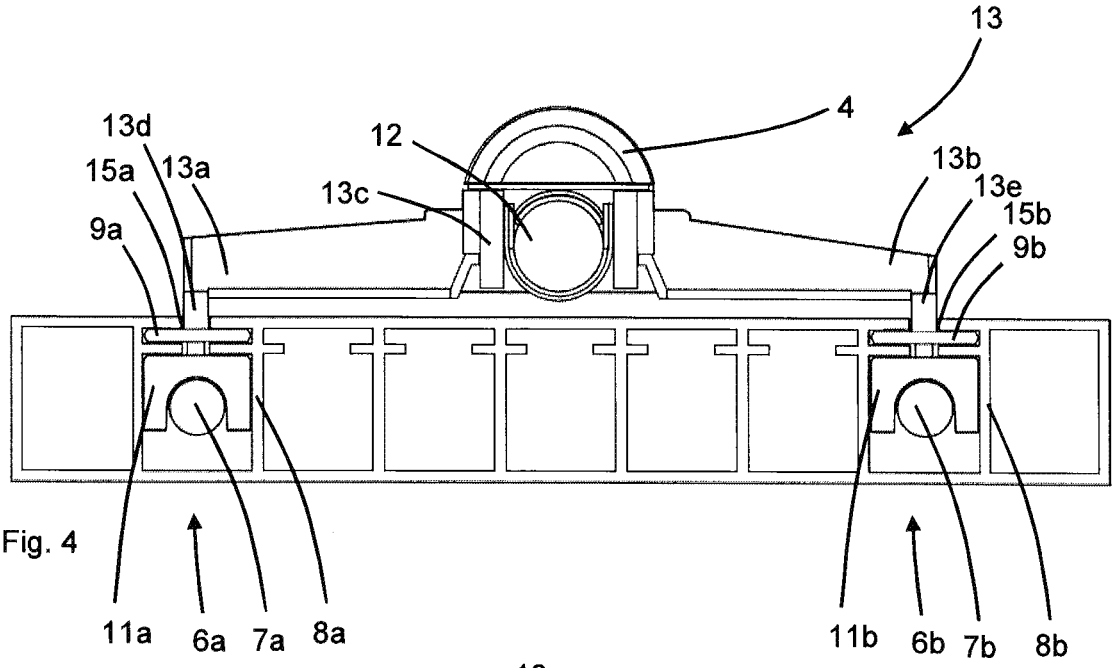
FIG. 4 shows a cross section view of parts of an antenna feeding network of a multi radiator antenna according to an embodiment of the invention.

FIG. 4 shows a cross section view of parts of an antenna feeding network of a multi radiator antenna according to an embodiment of the invention. The feeding network comprises a plurality of parallel coaxial lines. The figure shows two coaxial lines 6*a*, 6*b* which each comprise a central inner conductor 7*a*, 7*b*, an elongated outer conductor 8*a*, 8*b* forming a cavity or compartment around the central inner conductor, and an elongated rail element 9*a*, 9*b* slideably arranged inside the outer conductor. The outer conductors 8*a*, 8*b* have square cross sections and are formed integrally and in parallel to form a self-supporting structure.

The rail elements 9*a*, 9*b* are longitudinally movable relative the outer conductors. Each coaxial line 6*a*, 6*b* is provided with a dielectric element 11*a*, 11*b* which is attached to the corresponding elongated rail element 9*a*, 9*b* and is configured to co-operate with the corresponding coaxial line 6*a*, 6*b*. The dielectric elements 11*a*, 11*b* both have a U-shaped cross section and are arranged around the respective inner conductor 7*a*, 7*b* such that it partially surrounds the inner conductor and fills most of the cavity between the conductors. Arranging the dielectric elements 11*a*, 11*b* in the cavity between the inner and outer conductor forms a phase shifting device arranged to adjust the phase of signals in coaxial line 6*a*, 6*b*. Since the dielectric elements 11*a*, 11*b* are each attached to a corresponding rail element 9*a*, 9*b*, the phase may be adjusted by moving or sliding the rail elements longitudinally until the desired position and phase shift is achieved. By varying the phase shift in the feeding network, it is possible to control the direction of the antenna main beam in the elevation angle; this is often referred to as controlling the antenna downtilt, or antenna tilt. The indicating portion 4 is formed as a portion of the connecting element 13. In other embodiments, the indicating portion 4 is a separate part or element which is connected to (but separate from) the connecting element 13.

The rail elements are moved or displaced using displacement means which comprises a threaded rod 12 which extends longitudinally (in the depth direction as seen in the figure) and a connecting element 13 which comprises a first arm portion 13*a* and a second arm portion 13*b*, each connected to a respective rail element 9*a*, 9*b* via respective attachment portions 13*d*, 13*e*. The connecting element is provided with an internally threaded portion 13*c* having pitch and dimensions adapted to co-operate with the threaded rod. The rail element is connected to dielectric elements 11*a*, 11*b*. Thus, when the rod 12 is rotated, the connecting element 13 and the thereto connected rail element 9*a*, 9*b* and consequently also the dielectric elements 11*a*, 11*b* move in the longitudinal direction, thus adjusting the phase shift of the coaxial lines. The rod may be rotated manually or using an electric motor controlled by a controlling device such as micro-controller. When using electric motors, the dielectric elements, and hence the downtilt of the antenna, can be controlled remotely. Remote control can be achieved e.g. by connecting the motor and micro-controller to a network control center, or a lap top computer, or some other means for control. Although only two of the outer conductors or channels are provided with inner conductors in FIG. 4, it is realized that one or a plurality of the shown empty outer conductors may also be provided inner conductors, and optionally rail elements and dielectric elements. The connecting element 13 is connected to the rail elements 9*a*, 9*b* via attachment portions 13*d*, 13*e* arranged through elongated slots 15*a*, 15*b* in the respective outer conductor.

Figure 5:
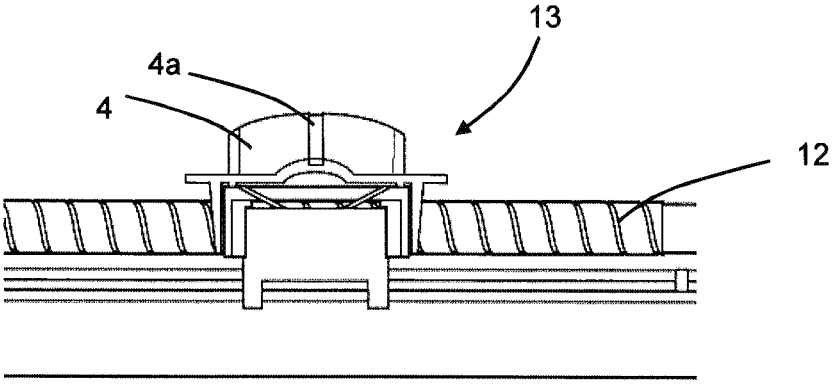
FIG. 5 shows parts of the antenna feeding network in FIG. 4 as seen from the side.

FIG. 5 shows parts of the antenna feeding network in FIG. 4 as seen from the side, where the threaded rod 12 and the connecting element 13 are shown. The indicating portion 4 is formed as a rounded protrusion having an indicating line or groove 4*a* thereon.

Figure 6:
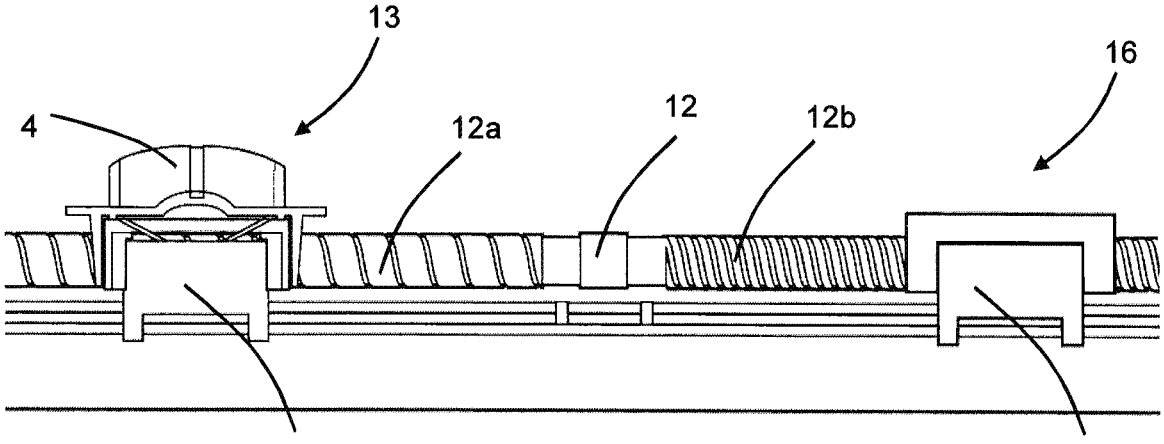
FIG. 6 shows parts of an antenna feeding network of a multi radiator antenna according to the invention.

FIG. 6 shows parts of an antenna feeding network of a multi radiator antenna according to an embodiment of invention. The embodiment is similar to that shown in FIGS. 4-5, but differs mainly in that the displacement means is configured to move at least two rail elements simultaneously at different speeds. This is achieved by having two threaded portions 12*a*, 12*b* with different pitch on the longitudinally extending rod 12, and first and second connecting elements 13, 16, each connecting element being provided with an internally threaded portion 13*c*, 16, the internally threaded portions being configured to co-operate with corresponding (externally) threaded segments or portions 12*a*, 12*b* of the rod 12. The threaded segment or portion 12*a* of the rod has a greater pitch than the other threaded segment or portion 12*b*, such that the first connecting element 13 moves at a greater speed than the second connecting element 16 when the rod is rotated. The connecting elements 13, 16 are connected to respective rail elements (not shown) through elongated slots in the outer conductors in the same way as shown in FIG. 4. The displacement means illustrated in FIG. 6 may be combined with two or more splitter/combiners of the differential phase shifting type. Thus, the means for moving may be configured to move a rail element and dielectric element of a first splitter/combiner simultaneously and at a different speed than a rail element and dielectric of a second splitter/combiner. Such a combination including a plurality of differential phase shifters may be used in an antenna to provide a variable electrical tilt angle. It is noted that it is only necessary to provide one of the connecting elements with an indicating portion 4 since the relative movement between the two connecting elements is predetermined due to the ratio of their pitches.

Figure 7:
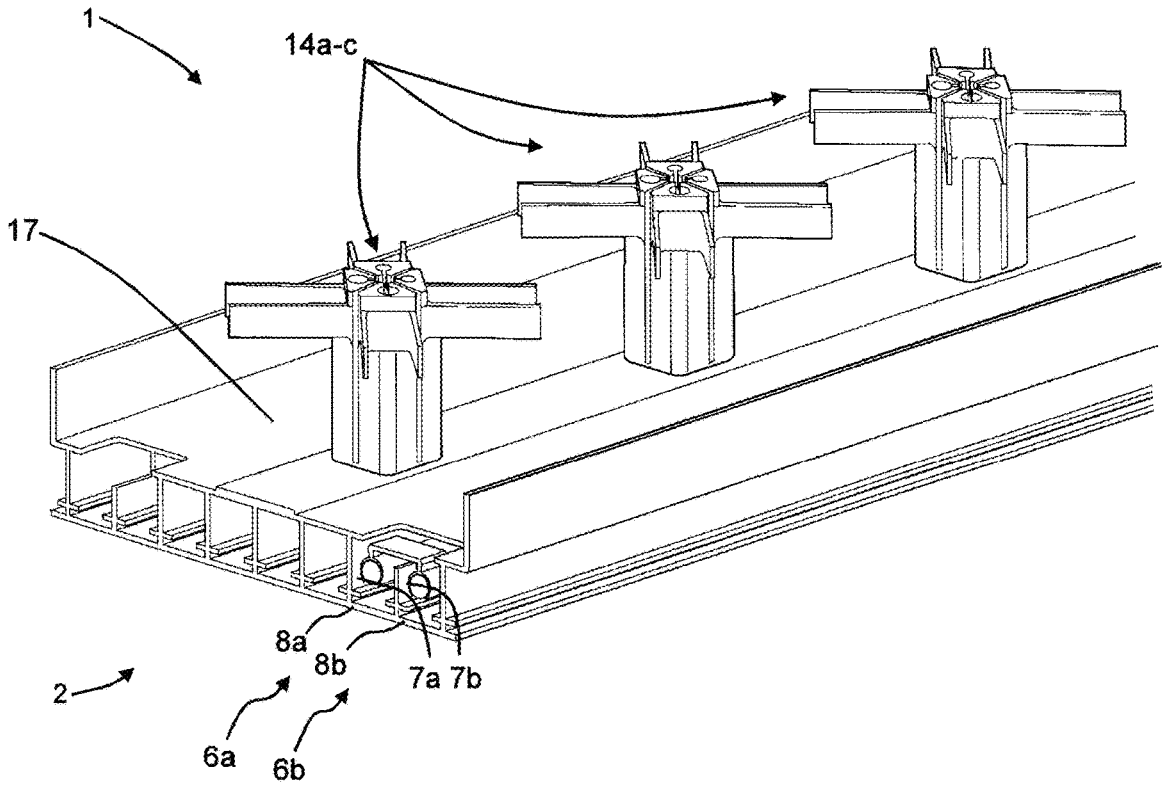
FIG. 7 shows a multi radiator antenna according to an embodiment of the invention.

FIG. 7 shows parts of a multi radiator antenna according to an embodiment of the invention as seen from the reflector front side. The antenna comprises an antenna feeding network 1, a reflector 17 and three radiating elements or dipoles 14*a-c* arranged on the reflector. For illustrative purposes, the antenna is shown without its protective cover(s) which normally cover(s) the reflector, the radiating elements and the antenna feeding network (at least partly). The antenna feeding network is provided with coaxial lines 6*a*, 6*b* having central inner conductors 7*a*, 7*b* and outer conductors 8*a*, 8*b*. The outer conductors 8*a*, 8*b* have square cross sections and are formed integrally and in parallel to form a self-supporting structure. The wall which separates the coaxial lines 6*a*, 6*b* constitute vertical parts of the outer conductors 8*a*, 8*b* of both lines. In this figure, it is illustrated how the coaxial lines are integrally formed with the reflector in the sense that the reflector 17 is formed by the upper walls of the outer conductors. The antenna feeding network is thus similar to that shown in FIG. 4 except for that different outer conductors are provided with inner conductors to form coaxial lines. The antenna feeding network is further provided, on its rear side (opposite of the reflector front side 17), with means for adjusting relative phase of the same type as illustrated in FIG. 4 and described above, but this is not visible in the figure. It is realized that the number of inner conductors (two) and number of radiators (three) shown are only for illustrative purposes, and that further inner conductors may be used to provide a splitting/combing antenna feeding network of the type shown in FIG. 1.

Figure 8:
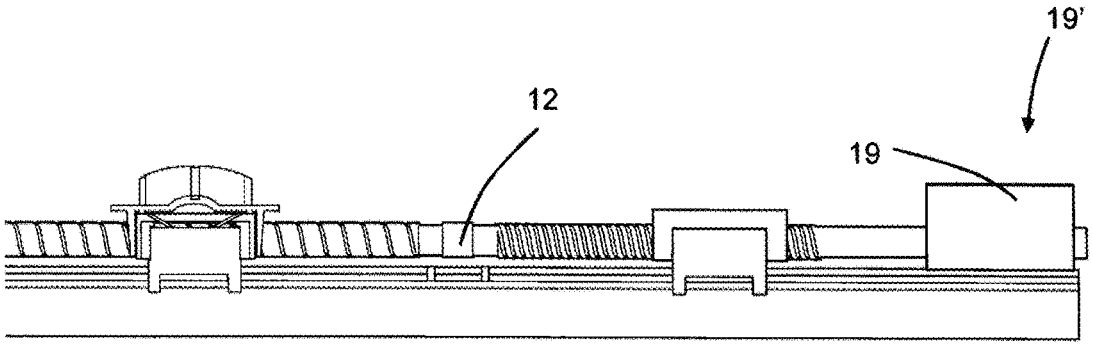
FIG. 8 shows parts of an antenna feeding network of a multi radiator antenna according to an embodiment the invention.

FIG. 8 shows parts of an antenna feeding network of a multi radiator antenna according to an embodiment of the invention. The embodiment corresponds to that shown in FIG. 6 and further comprises an electrical actuating arrangement including an electric motor unit 19' comprising an electric motor 19 connected to the longitudinally extending threaded rod 12 to allow rotation thereof.

Figure 9:
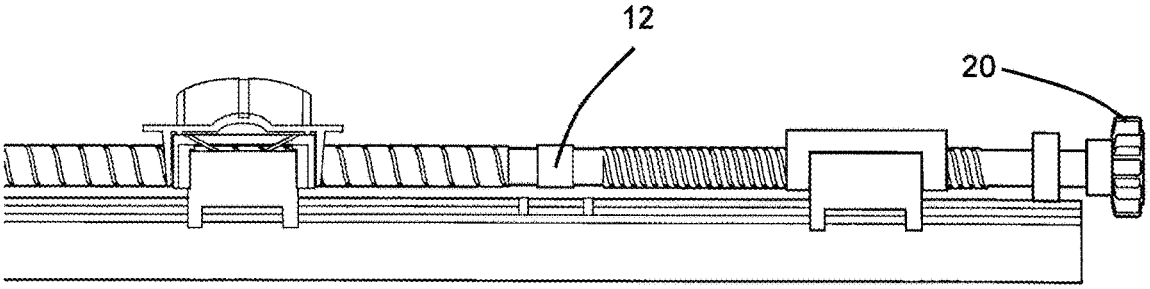
FIG. 9 shows parts of an antenna feeding network of a multi radiator antenna according to an embodiment of the invention.

FIG. 9 shows a similar embodiment to that shown in FIG. 8, but differs in that a manual actuating arrangement comprising a handle or knob 20 is provided (instead of the electrical actuating arrangement), which handle or knob allows manual rotation of the longitudinally extending threaded rod 12.

Figure 10:
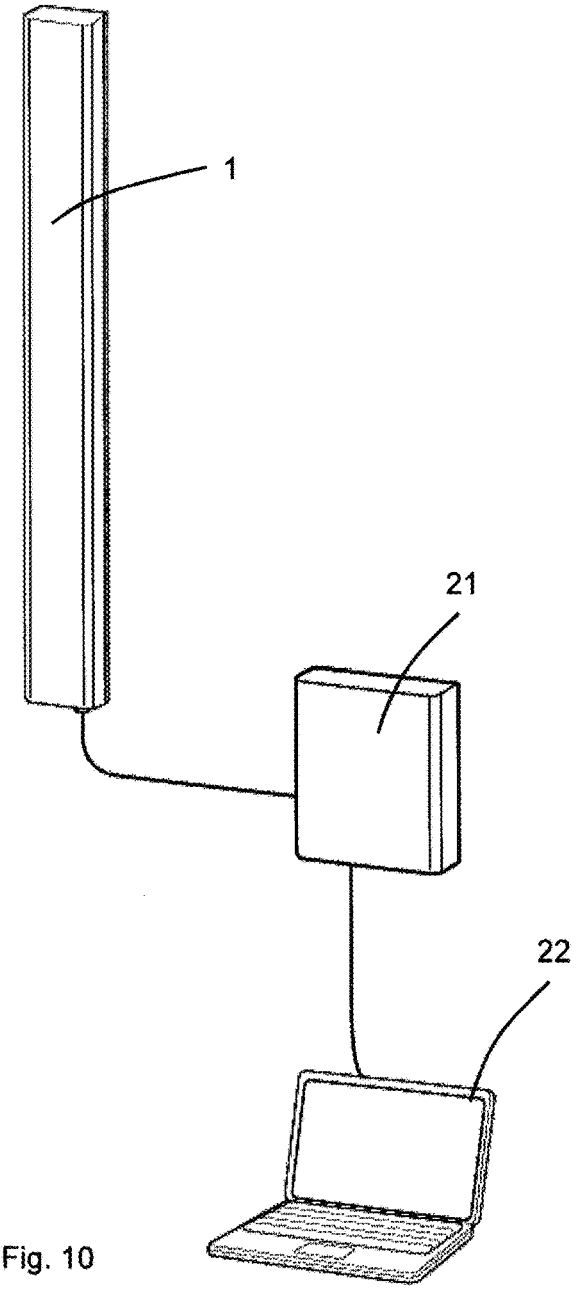
FIG. 10 shows a multi radiator antenna according to an embodiment of the invention.

FIG. 10 shows a multi radiator antenna 1 according to an embodiment of the invention. The multi radiator antenna comprises an electrical actuating arrangement (not visible since the antenna is provided with a protective cover). The electrical actuating arrangement may be of the type shown in FIG. 8 and described above. The antenna further comprises means for controlling said electrical actuating arrangement from a distance in the form of a control unit 21 which is connected to the electrical actuating arrangement via a wired connection or cable. The control unit is in turn connected to a computer 22 provided with software for communicating with the control unit 21 in order to send/receive signals thereto. The computer 22 can be located in a network control center, or it can be a portable computer brought to a cellular base station, or any other location. In this embodiment, the control unit is physically connected to the computer by means of a wired connection or cable. In other embodiments, the control unit may be connected to the computer or another device such as a smart phone or a tablet via a wireless connection. In this embodiment, relative phases of the signals in the antenna may be adjusted from the computer, i.e. from a distance, in order to adjust the antenna main beam angle in the elevation plane. The control unit can be a specific unit designed just for communicating with the electrical motor unit, or it can be a cellular base station which is equipped for communicating with the motor unit, or some other type of device.

The description above and the appended drawings are to be considered as non-limiting examples of the invention. The person skilled in the art realizes that several changes and modifications may be made within the scope of the invention. For example, the tilt angle range may be varied, the number of coaxial lines may be varied, the number of radiators or dipoles may be varied, the number of coaxial lines provided with rail elements may be varied, the number of coaxial lines provided with dielectric elements and/or support elements may be varied, and the shape of the support element(s) and dielectric element(s) may be varied. Furthermore, the reflector does not necessarily need to be formed integrally with the coaxial lines, but may on the contrary be a separate element. The scope of protection is determined by the appended patent claims.

The invention claimed is:

1. A multi radiator antenna comprising an electrically conductive reflector, at least two radiating elements arranged on said reflector, a feeding network connected to said radiating elements, and a protective cover arranged to protect the feeding network, wherein said feeding network comprises a plurality of conductors for distributing signals to said radiators, said feeding network having means for adjusting relative phases of said signals in order to adjust the direction of the antenna main lobe of said multi-radiator antenna, wherein said means for adjusting is provided with, or is connected to, an indicating portion configured to provide a visual indication of said direction, and wherein said protective cover is provided with an at least partially transparent wall portion having a scale and wherein the protective cover is arranged such that the position of said indicating portion is visible there through and said indicating portion is configured to co-act with said scale to indicate said position.

2. The multi radiator antenna according to claim 1, wherein said means for adjusting relative phases of said signals is configured to adjust the antenna main beam angle in the elevation plane.

3. The multi radiator antenna according to claim 1, wherein said plurality of conductors of said feeding network are configured as substantially air filled coaxial lines, each comprising a central inner conductor and an elongated outer conductor surrounding the central inner conductor.

4. The multi radiator antenna according to claim 3, wherein the substantially air filled coaxial lines are integrally formed with the reflector.

5. The multi radiator antenna according to claim 1, wherein said means for adjusting comprises at least one dielectric element, each configured to co-operate with at least one of said conductors to provide a phase shifting arrangement.

6. The multi radiator antenna according to claim 5, wherein said means for adjusting comprises displacement means configured to displace said at least one dielectric element and said indicating portion.

7. The multi radiator antenna according to claim 6, further comprising a manual actuating arrangement configured to actuate said displacement means, which actuating arrangement comprises a handle or knob.

8. The multi radiator antenna according to claim 6, further comprising an electrical actuating arrangement configured to actuate said displacement means, which electrical actuating arrangement comprises at least one electric motor.

9. The multi radiator antenna according to claim 8, further comprising means for controlling said electrical actuating arrangement from a distance.

10. The multi radiator antenna according to claim 3, further comprising at least one elongated rail element, each being slideably arranged inside an outer conductor of said coaxial lines, said rail element being longitudinally movable in relation to said outer conductor, wherein said means for adjusting further comprises at least one connecting element connected to the rail element of at least one of said coaxial lines, said connecting element being provided with said indicating portion, and wherein each of said at least one dielectric element is configured to co-operate with a corresponding coaxial line by being attached to an elongated rail element arranged therein.

11. The multi radiator antenna according to claim 10, wherein said outer conductor is provided with at least one longitudinally extending slot, and wherein said connecting element is connected to said rail element through said slot.

12. The multi radiator antenna according to claim 1, wherein said protective cover at least partly covers or surrounds the antenna feeding network and/or the reflector and/or the radiators.

13. A multi-radiator antenna with capability for adjustment of the direction of the antenna main lobe of said multi-radiator antenna, comprising:

an electrically conductive reflector;

at least two radiating elements arranged on said reflector;

a feeding network connected to said radiating elements and having:

a plurality of conductors connecting a connector to said radiating elements; and a phase adjusting mechanism connected to an indicating portion;

a protective cover arranged to protect the feeding network and provided with a scale located adjacent to the indicating portion thereby providing a visual indicate position of the phase shifting mechanism.

14. The multi-radiator antenna with capability for adjustment of the direction of the antenna main lobe of said multi-radiator antenna of claim 13, wherein said phase adjusting mechanism is configured to adjust the antenna main beam angle in the elevation plane.

15. The multi radiator antenna according to claim 13, wherein said plurality of conductors of said feeding network are configured as substantially air filled coaxial lines, each comprising a central inner conductor and an elongated outer conductor surrounding the central inner conductor.

16. The multi radiator antenna according to claim 15, wherein the substantially air filled coaxial lines are integrally formed with the reflector.

17. The multi radiator antenna according to claim 13, wherein said phase adjusting mechanism comprises at least one dielectric element, each configured to co-operate with at least one of said conductors to provide a phase shifting arrangement.

18. The multi radiator antenna according to claim 17, wherein said phase adjusting mechanism is configured to displace said at least one dielectric element and said indicating portion.

19. The multi radiator antenna according to claim 18, further comprising a manual actuating arrangement configured to actuate displacement of said dielectric element and said indicating portion, which actuating arrangement comprises a handle or knob.

20. The multi radiator antenna according to claim 18, further comprising an electrical actuating arrangement configured to actuate said displacement of said dielectric element and said indicating portion, which electrical actuating arrangement comprises at least one electric motor.

21. The multi radiator antenna according to claim 20, further comprising means for controlling said electrical actuating arrangement from a distance.

22. The multi radiator antenna according to claim 15, further comprising at least one elongated rail element, each being slideably arranged inside an outer conductor of said coaxial lines, said rail element being longitudinally movable in relation to said outer conductor, wherein said means for adjusting further comprises at least one connecting element connected to the rail element of at least one of said coaxial lines, said connecting element being provided with said indicating portion, and wherein each of said at least one dielectric element is configured to co-operate with a corresponding coaxial line by being attached to an elongated rail element arranged therein.

23. The multi radiator antenna according to claim 22, wherein said outer conductor is provided with at least one longitudinally extending slot, and wherein said connecting element is connected to said rail element through said slot.

24. The multi radiator antenna according to claim 13, wherein said protective cover at least partly covers or surrounds the antenna feeding network and/or the reflector and/or the radiators.

* * * * *